US005101753A

United States Patent [19]

Hull et al.

[11] Patent Number: 5,101,753

[45] Date of Patent: Apr. 7, 1992

[54] ATTACHABLE SEAT FOR INFLATABLE BOAT

[76] Inventors: Harold L. Hull, 401 Canyon Way, Space 43, Sparks, Nev. 89434; James E. Morris, 1430 Bridgewood La., Reno, Nev. 89503

[21] Appl. No.: 222,161

[22] Filed: Jul. 21, 1988

[51] Int. Cl.[5] ..... B63B 17/00

[52] U.S. Cl. ..... 114/345; 114/363

[58] Field of Search ..... 114/345, 363; 248/640, 248/641; 441/130-132, 126, 127

[56] References Cited

U.S. PATENT DOCUMENTS

| | | | |
|---|---|---|---|
| 382,935 | 5/1888 | Ashworth | 441/126 |
| 1,118,208 | 11/1914 | McLaren | 248/641 |
| 3,795,927 | 3/1974 | Darwin, Jr. | 114/363 |
| 3,825,962 | 7/1974 | Grounds et al. | 114/363 |
| 4,348,779 | 9/1982 | Leber | 114/345 |
| 4,771,722 | 9/1988 | Tihany | 114/363 X |

*Primary Examiner*—Sherman Basinger

[57] ABSTRACT

An attachable, swivel seat for an inflatable boat that sets firmly and freely on the main frame of the motor mount, the seat having adjustable cross members to fit its own motor mount or most other types of motor mounts. This attachable seat also has an adjustable brace from the cross member to the floor of the boat and a platform behind it which can support a battery or the like, and said attachment also provides space where fishing rod holders may be mounted. This attachable seat may be moved forward or backward and places the occupant above the gunwales in a position to comfortably operate the controls of a trolling motor with plenty of leg room and in the event of a tear or serious air leak or the boat capsizes, the seat is a floatation device.

10 Claims, 1 Drawing Sheet

ATTACHABLE SEAT FOR INFLATABLE BOAT

FIELD OF INVENTION

This invention relates to an attachable seat for inflatable boats and the like.

BACKGROUND OF THE INVENTION

In the past a number of attachable seats have been devised for boats including rubber or inflatable rafts, canoes, and row boats or the like which are supported by the gunwales and generally involve oarlocks.

The following patents define structures which would appear to be germane to the patentability of this invention.

2,815,517 Andersen, Jr.
4,290,156 Rawson
3,71B365 Gibson
4,672,911 Hodgins
3,898,950 Martin
4,068,611 Leather The patents to Andersen teaches the use of a seat supported by the gunwales of the craft and having oarlocks therein.

Likewise, Leather and Martin teach the use of oarlocks integral with a removable seat.

Gibson shows an attachable swivel seat which must be attached to the gunwales.

Rawson also defines a seat involving oarlocks and a storage compartment.

OBJECTS OF THE INVENTION

It is an object of this invention to provide an attachable seat for an inflatable craft which engages with to and/or becomes an integral part of the motor mount.

It is a further object to provide a seat which is adjustable to readily adapt to any conventional inflatable raft with or without a motor mount.

It is a further object to provide a seat which provides leg room for the fishermen or the like and which allows him to set above the gunwales in a comfortable position from which he can operate the controls for the trolling motor or the like.

It is a further object to provide on the attachable seat assembly, space where pole holders may be attached.

It is a further purpose to provide means for the attachment to set on and engage with the motor mount with out clamping or any additional hardware.

It is a further object to provide an attachable seat that in an inverted position will readily be free from the craft and provide floatation means.

It is another object to provide a seat which can swivel.

Still another object of the invention is to provide additional space behind the seat on the platform for additional items such as a battery, gas tanks, storage box or the like.

Yet another object is to provide adjustable means to support or brace the seat to the floor of the craft

DETAILED DESCRIPTION OF THE DRAWINGS

Figure 1:
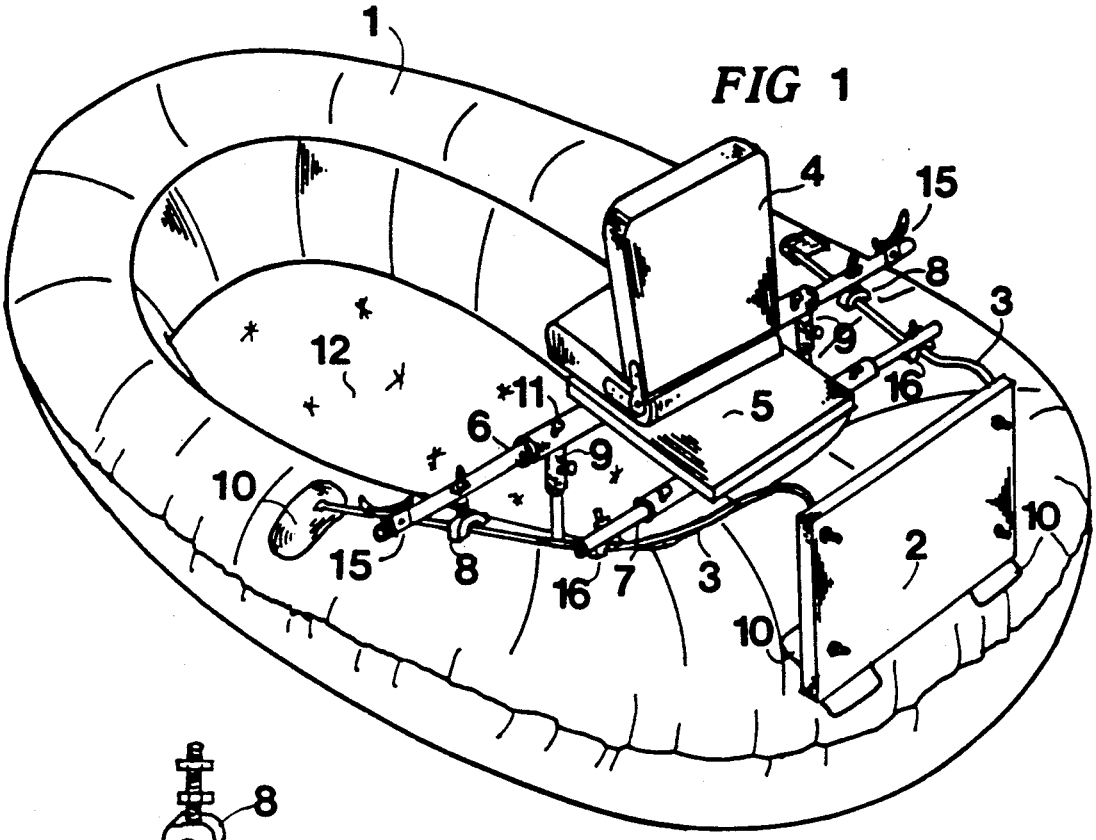
FIG. 1 is a perspective view of the invention mounted on an inflatable raft.
Figure 3:
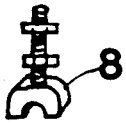
FIG. 3 is a side view of the seat attachment.
Figure 4:
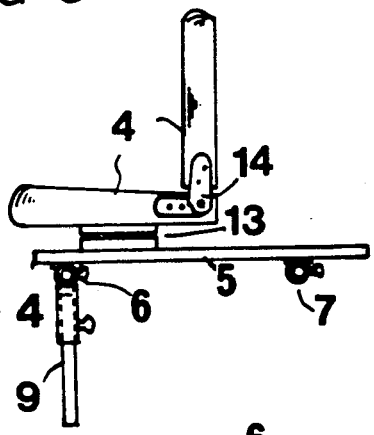
FIG. 4 is a perspective view of item 8 in FIG. 1.
Figure 2:
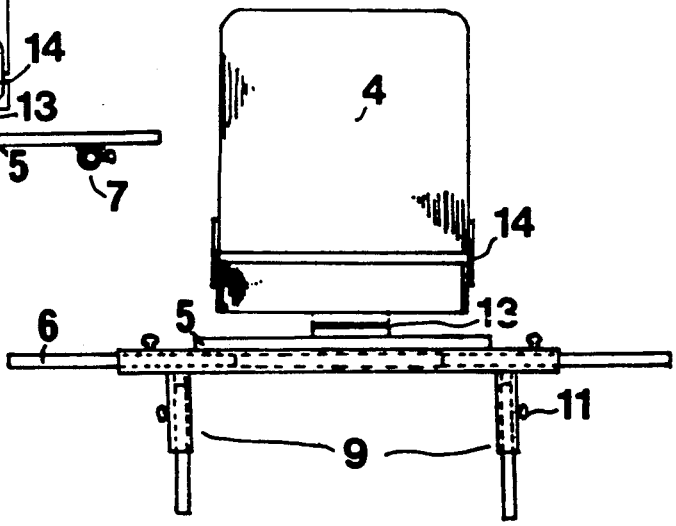
FIG. 2 is a front view of the seat attachment.

1 is an inflatable boat or raft, while 2 is a motor mount support and 3 is the frame work attaching the motor mount to the said boat or raft, while 4 is a seat or chair with 5 being the platform for said seat to mount on, while 6 is a forward telescoping support structure, while 7 is a rear telescoping support structure and 8 is an adjustable riser between the forward telescoping structure 6 and the motor mount support 2, while 9 is a telescoping brace or support, and 10 are mounting patches on the raft, with 11 being thumb screws or the like (6 places), while 12 is the wooden floor of the raft, and 13 is a means for seat 4 to swivel, 14 being a folding bracket for seat 4, and 15 are fishing rod holders, while 16 are mounts for rear telescoping support structure.

OPERATION

In use of the attachment of the present invention, the attachment is placed above the motor mount support 2 and the telescoping support structures, 6 and 7, are loosened by thumb screws 11 and extended until the adjustable risers 8 and the rear telescoping support mounts 16 are setting on top of the motor mount support 2, then the entire attachment can slide forward or backward on the motor mount support 2 until the desired position is reached, at which time the thumb screws 11 are tightened and the attachment now cannot slide forward or backward. The telescoping braces or supports 9 are now adjusted so that the foot or bottom of the said braces or supports are resting on the wooden floor 12 of the raft. The pole holders 15 can now be mounted on the ends of the forward telescoping support structure 6 and other items as desired may be placed behind the seat on platform 5 such as a battery, coldbox, fishing tackle or the like.

It will now be seen that the fisherman or operator is setting above the gunwales with adequate leg room and on a seat which can swivel so that he may reach the motor controls or the fishing rods or the like.

It will also be seen that in the event of a serious air-leak in the raft or the raft should capsize, that the seat attachment which is simply setting on the motor mount supports 2 will readily float free providing a floatation devise.

Although the invention has been herein shown and described in what is conceived to be the most practical and preferred embodiments, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A seat attachment for a boat comprising: a platform, front and rear cross-members extending transversely over said boat, means to connect said cross-members to said platform, a motor mount including a mounting frame, means engaging said cross-members with said motor mount, said rear cross-member being substantially shorter than said front cross-member and a seating member attached to said platform.

2. The device of claim 1 in which said boat is inflatable.

3. The device of claim 1 in which said front and rear cross-members are telescopic, said telescopic cross-members having locking means to lock said telescopic cross-members in multiple extended positions.

4. The device of claim 1 in which means engaging said cross-members to said motor mount is released when said boat is in a substantially inverted position.

5. The device of claims 1 in which said means engaging said cross-members to said motor mount, is an adjustable support member, said support member setting freely on and cooperating with said motor mount.

6. The device of claim 1 in which said seating member is a swivel seat.

7. The device of claim 1 in which said boat has a floor and means to brace said cross-members to said floor.

8. The device of claim 7 in which said means to brace said cross-members to said floor is telescopic and means to lock said telescopic brace in multiple positions.

9. The device of claim 1 in which said seating member is a floatation device.

10. A seat attachment for an inflatable boat comprising a main frame, means to engage said main frame longitudinally from the gunwales to mid-rear section of said inflatable boat, said main frame supporting a platform, said platform supporting a seating member, a motor mount, means to engage said main frame to said motor mount, said means to engage said main frame with said motor mount being an adjustable support member and said support member setting freely on and cooperating with said motor mount.

* * * * *